United States Patent [19]

Hillman

[11] 4,037,499

[45] July 26, 1977

[54] METHOD AND APPARATUS FOR PERFORATING FIBROUS BOARD SURFACES IN NON-REPETITIVE PATTERNS

[75] Inventor: Theodore E. Hillman, Cloquet, Minn.

[73] Assignee: Conwed Corporation, St. Paul, Minn.

[21] Appl. No.: 652,427

[22] Filed: Jan. 26, 1974

[51] Int. Cl.[2] ..... B26F 1/24

[52] U.S. Cl. ..... 83/1; 83/2; 83/98; 83/101; 144/2 K

[58] Field of Search ..... 83/2, 101, 98, 660, 83/1; 144/2 K

[56] References Cited

U.S. PATENT DOCUMENTS

| | | | |
|---|---|---|---|
| 2,010,078 | 8/1935 | Hale | 83/101 |
| 3,013,937 | 12/1961 | Brown et al. | 83/1 |
| 3,461,754 | 8/1969 | Griffen | 83/2 |
| 3,470,978 | 10/1969 | Wagtskjold et al. | 83/2 |
| 3,680,419 | 8/1972 | Stoop | 83/98 |

*Primary Examiner*—Donald R. Schran

*Attorney, Agent, or Firm*—Eyre, Mann, Lucas & Just

[57] ABSTRACT

A method and apparatus for perforating and, if desired, eroding fibrous board surfaces in a non-repetitive pattern are disclosed. The boards perforated according to the present invention are especially useful as acoustical tiles and panels. The board is formed and dried with a surface pattern developed on the board surface if desired and thereafter the board surface is punched by a series of randomly arranged pins or tacks on a plurality of rolls whereby a non-repetitive pattern results.

7 Claims, 2 Drawing Figures

METHOD AND APPARATUS FOR PERFORATING FIBROUS BOARD SURFACES IN NON-REPETITIVE PATTERNS

BACKGROUND OF THE INVENTION

1. Field of the Invention

The present invention relates to method and apparatus for perforating fibrous board surfaces in non-repetitive patterns. The board is especially suited for use as acoustical tiles and panels.

2. Description of the Prior Art

Known methods and apparatus for perforating fibrous board surfaces employ pattern forming members which are capable of forming only the single pattern associated with the particular member. Proudfoot et al U.S. Pat. No. 2,791,289 discloses the formation of holes and fissures in board surfaces by eroding selected portions of the board surface through a stencil member by sand-blasting. Another known method is to use cutting or pressing dies, roll or punch type, to press or cut perforations into the board surface, as taught in Carlson et al U.S. pat. No. 3,202,025 and Norsted U.S. Pat. No. 3,230,813. However, complete randomness is not possible using a finite number of stencils or dies and repetitive patterns result. In Thomas et al U.S. Pat. No. 3,077,945, varients of a generalized pattern are formed on board surfaces by varying the contours of already formed standard fissures. However, the number of varients is limited by the number of varient forms, and repetitive patterns result. All of the foregoing processes require the use of multiple dies, stencils, etc. to vary the pattern, which entails great expense and complexity, and none are capable of producing a random, non-repetitive pattern.

The present invention obviates the foregoing disadvantages and drawbacks and is capable of producing a random, non-repetitive pattern in a fibrous board product.

SUMMARY OF THE INVENTION

The present invention is embodied in and carried out by a method and apparatus for producing random, non-repetitive patterns in fibrous board surfaces. This is, accomplished by punching a plurality of randomly spaced perforations or holes in the board surface from a plurality of punch rolls. The randomness of the punched perforation or hole spacing is accomplished by punching the board with a plurality of randomly spaced protrusions in the form of pins or tacks extending from a plurality of rollers.

BRIEF DESCRIPTION OF THE DRAWING

These and other aspects of the present invention will be more apparent from the following detailed description of the invention when considered in conjunction with the accompanying drawings in which.

DESCRIPTION OF THE PREFERRED EMBODIMENT

Figure 1:
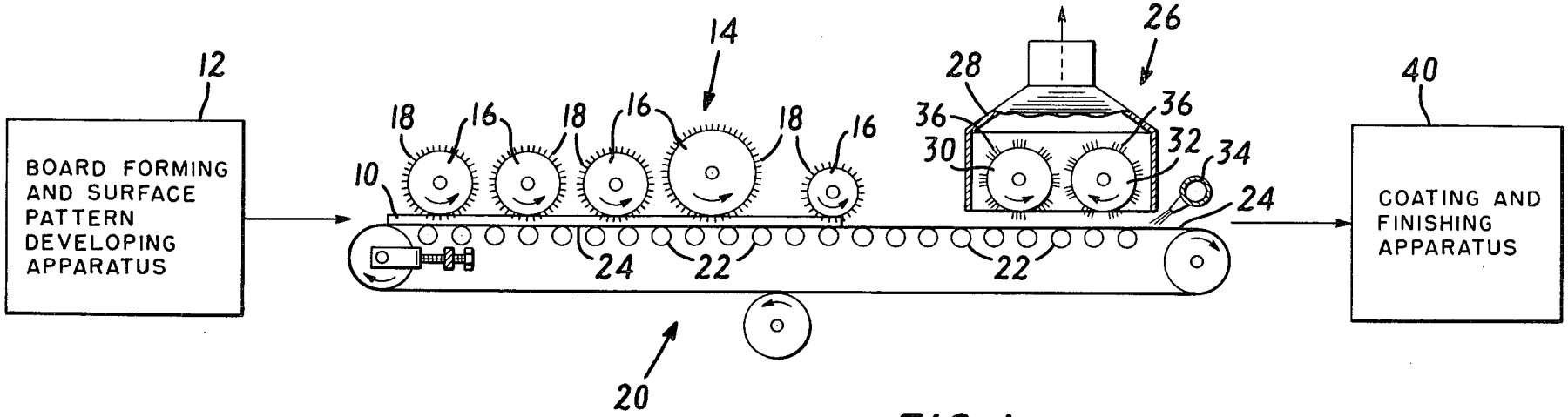
FIG. 1 shows an apparatus according to the invention for randomly punching the board surface.

Referring to FIG. 1, a fibrous board 10 is formed in known manner and, if desired, a surface such as fissures, cavities or the like an be developed thereon in known manner by board forming and pattern developing apparatus 12. (See for example U.S. Pat. No. Re 27,109). The board may comprise, for example, mineral, felt or vegetable fibers or combinations thereof. Thereafter, the board 10 is fed in dried form to punching apparatus 14. Apparatus 14 includes a plurality of punch rolls 16, each having a plurality of randomly spaced protrusions in the form of pins or tacks 18 extending therefrom. The formed board 10 is fed to conveyor 20 which moves the board past rolls 16. Conveyor rollers 22 assist in supporting board 10. Rolls 16 are positioned an appropriate distance above conveyor 20 so that board 10 may pass between rolls 16 and conveyor surface 24. This distance is dependent upon the board thickness. For standard ceiling tiles which are about $\frac{3}{4}$ inch thick, pins having a length of $\frac{3}{8}$ inch or greater will penetrate the board to a maximum depth of about $\frac{3}{8}$ inch when passed under rolls 16 according to the present invention. If desired, the configuration, length and spacing of the pins may be designed to loosen and separate material from the board surface to give an eroded appearance and this is especially suitable for boards which are formed with fissures or cavities. For example, $\frac{3}{8}$ inch carpet tacks randomly spaced about 15 to 20 to the square inch has been found suitable for standard $\frac{3}{4}$ inch mineral board. Material may be loosened even in the bottom of the pattern fissures and cavities.

Thereafter, the board is suitably moved by conveyor 20 to material remover 26 comprising dust hood 28, brush rolls 30, 32 and air jet 34. Extending from brush rolls 30, 32 are a plurality of brushes 36 of soft bristles, fibers or the like. Rotation of brush rolls 30, 32 in opposite directions as shown causes loosened material to be gently removed from the board and lifted by the brushes 36. The lifted material is removed through dust hood 28 in known manner. Air jet 34 releases a stream of air which removes loosened material from smaller holes and cavities. The material separated by the air stream is also removed through dust hood 28. The randomly, non-repetitively patterned board is then fed to apparatus 40 for coating, finishing, etc.

The probability of a recurring pattern is reduced as the number of punch rolls 16 is increased. Although two punch rolls would establish a random pattern with a low probability of recurrence, three or more are preferred and a minimum of four insures that the probability of a recurring pattern is negligible. To further reduce the probability of a recurring pattern, the rolls 16 are made of varying diameters and the spacing between rolls may be made non-uniform.

Patterns are non-recurring when formed according to the present invention because the probability is negligible that the pins or tacks will punch the same holes in exactly the same location for any two cut boards. In constrast, a random, non-repetitive pattern cannot be achieved when punching the board with regularly spaced pins or tacks.

Figure 2:
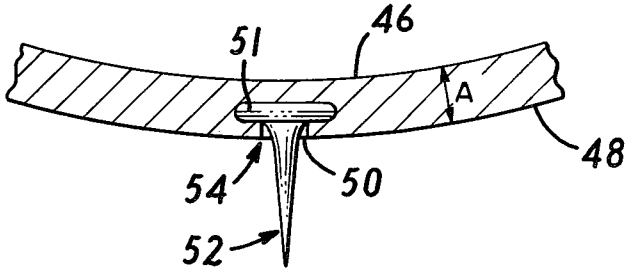
FIG. 2 shows a detailed embodiment of the preferred-method of securing a perforating member.

The pins or tacks 18 are preferably movably secured to the respective rolls 16, i.e., the pins are loosely secured in appropriate receptacles in the rolls. This can suitably be accomplished as shown in FIG. 2 wherein a carpet tack is secured. As there shown, the roll 46 has an outer shell 48 with a tack receiving perforation 50 therein. Because the distance A is greater than the thickness of the head 51 of the carpet tack 52 and because the hole 50 is of greater diameter than the diameter of the tack 52 in the area of the main body 54 which passes through the perforation, the tack is free to move with respect to the roller. This provides for improved release of the board by the pins so that excessive erosion does not take place. It is preferred that the pins or tacks be carpet tacks or nail-tip shaped, i.e., that they be pointed at their tips. This also assists in the release and improves the self-cleaning aspect of the pins.

Apparatus for forming the board per se is well known to those skilled in the art. Similarly coating and finishing apparatus are well known to those skilled in the art and may include the following operations: spray prime hardening, acoustical punching, tile machining, roll coating, spray coating and the like.

Board in which patterns are formed according to the present invention have a more natural and aesthetically pleasing appearance due to the non-repetitive pattern. Removal of material from the bottom of fissures and cavitites enhances the appearance in that the depth of the pattern also appears more natural.

The advantages of the present invention, as well as certain changes and modifications of the disclosed embodiment thereof, will be readily apparent to those skilled in the art. For example, while randomly-spaced pins or tacks have been disclosed to accomplish the punching of the board surface, structure other than pins or tacks for accomplishing the punching will be apparent to those skilled in the art, e.g., a die pattern having randomly arranged protruding portions or edges will also serve to randomly punch or cut the board surface. It will therefore be understood that the claims are intended to cover all those changes and modifications which could be made to the embodiment of the invention herein chosen for the purposes of the disclosure without departing from the spirit and scope of the invention.

What is claimed is:

1. Apparatus for fissuring a fibrous board product of predetermined thickness comprising:

a. a substantially flat surface;

b. a plurality of rolls positioned above said surface, each said roll have an outer periphery;

c. a plurality of perforating members randomly spaced on the outer periphery of each said roll;

d. the distance from the ends of the said perforating means to the said flat surface being less than the predetermined thickness of the board product;

e. means for passing said board product between the said flat surface and the said plurality of rolls; and f. said perforating members being loosely secured in said rolls, whereby said perforating members are moveable with respect to their respective rolls.

2. Apparatus according to claim 1 further comprising removing means to remove any material separated from the board by said perforating members.

3. Apparatus according to claim 2, wherein said removing means comprises a pair of oppositely rotated juxtaposed rolls having a plurality of brushes mounted thereon.

4. Apparatus according to claim 3, wherein said removing means further comprises air means for directing a stream of air towards said punctures.

5. Apparatus according to claim 1, wherein at least some of the perforating means are pins.

6. The apparatus recited in claim 1 wherein at least a first of said rolls having a diameter different from at least a second of said rolls.

7. Apparatus for fissuring a fibrous board product of predetermined thickness comprising:

a. a substantially flat surface;

b. at least three rolls positioned above said surface, each said roll having an outer periphery;

c. a plurality of perforating members randomly spaced on the outer periphery of each said roll;

d. the distance from the ends of the said perforating means to the said flat surface being less than the predetermined thickness of the board product;

e. means for passing said board product between the said flat surface and the said plurality of rolls; and f. and the spacing between at least a first adjacent pair of rolls is different from the spacing between at least a second adjacent pair of rolls.

* * * * *